US006873303B2

(12) United States Patent
Creighton et al.

(10) Patent No.: US 6,873,303 B2
(45) Date of Patent: Mar. 29, 2005

(54) TELECOMMUNICATIONS MAST INSTALLATION

(76) Inventors: Barry Roger Creighton, 115 Leadwood Crescent, Moreleta Park Extension 36, 0044, Pretoria (ZA); Jock Milne Pretorius, 421 Beatrice Mare Street, Garsfontein Extension 8, 0042, Pretoria (ZA)

( * ) Notice: Subject to any disclaimer, the term of this patent is extended or adjusted under 35 U.S.C. 154(b) by 86 days.

(21) Appl. No.: 10/030,806

(22) PCT Filed: Mar. 8, 2001

(86) PCT No.: PCT/IB01/00325

§ 371 (c)(1),
(2), (4) Date: Jan. 11, 2002

(87) PCT Pub. No.: WO02/25768

PCT Pub. Date: May 28, 2002

(65) Prior Publication Data

US 2003/0142034 A1 Jul. 31, 2003

(30) Foreign Application Priority Data

Sep. 21, 2000 (ZA) ..... 2000/5067

(51) Int. Cl.[7] ..... H01Q 1/12
(52) U.S. Cl. ..... 343/890; 52/40
(58) Field of Search ..... 343/890–892, 343/878, 720, 874; 52/296, 40, 297, 79.9, 173.1

(56) References Cited

U.S. PATENT DOCUMENTS 4,016,462 A * 4/1977 Pavliny ..... 361/117
6,557,312 B2 * 5/2003 McGinnis ..... 52/296

* cited by examiner

*Primary Examiner*—James Vannucci
(74) *Attorney, Agent, or Firm*—Pauley Petersen & Erickson

(57) ABSTRACT

The invention concerns a telecommunications mast installation (10), typically a base station in a cellular telephone network, which includes a mast (14) supporting a telecommunications antenna (16). A foundation structure (12) supports the mast. The foundation structure is in the form of an enclosed chamber (24) situated at least partially underground and defining an internal space which is accessible to personnel and which accommodates electronic equipment associated with operation of the antenna. For aesthetic and security reasons, it is preferred that the chamber (24) be competely underground.

16 Claims, 4 Drawing Sheets

TELECOMMUNICATIONS MAST INSTALLATION

THIS invention relates to a telecommunications mast installation.

The invention is particularly concerned with a telecommunications mast installation in which a telecommunications mast supports one or more elevated antennas. The mast itself may be of monopole, lattice or other construction and may be made of steel or other materials. A typical example where the invention finds application is in the base station installations of cellular telephone networks.

Commonly a cellular telephone network base station installation includes a fenced or otherwise externally secured area in which are located an antenna-supporting mast supported on its own foundation and an exposed building alongside the mast which houses necessary electronic and other equipment, associated with the operation of the antenna including, for example, radio transmission and reception equipment.

It is recognised that base station installations of the type described above are extremely unsightly. In an attempt to address this problem, antenna-supporting masts have in the past been disguised as trees. Although this goes some way to addressing the problem, it still does not address the unsightliness of the external fencing and the building which accommodates the antenna-related equipment.

SUMMARY OF THE INVENTION

According to the present invention there is provided a telecommunications mast installation comprising a mast supporting a telecommunications antenna and a foundation structure supporting the mast, the foundation structure being in the form of an enclosed chamber situated at least partially, and preferably fully, underground and defining an internal space which is accessible to personnel and which accommodates electronic equipment associated with operation of the antenna.

In the preferred embodiments, the mast has a foot at its lower end which is supported on a base of the chamber, the base acting as a structural foundation for the mast. Typically in such embodiments, the foot of the mast is received by a seat in or on the base, the seat restraining lateral movements of the foot of the mast at the base. The seat may be in the form of a recess in the base. Typically also, the chamber includes lateral support means to restrain lateral movements of the mast at a position above the base. The chamber will preferably have a roof, at or slightly below ground level, with an opening therein through which the mast passes. There may be a sleeve about a lower end of the mast, the sleeve being received by the seat and passing through the opening in the roof.

In alternative, less preferred embodiments, the mast has a foot at its lower end which is connected rigidly to a roof of the chamber.

In either type of embodiment, it will be understood that the chamber forms an integrated structure which supports the mast and that the construction thereof will be in accordance with accepted civil engineering principles bearing in mind firstly the expected vertical and lateral loading the requirement that there should be no flooding of the chamber in view of the equipment accommodated therein. With the latter requirement in mind it is preferred that external access to the chamber, for example for personnel should be via openings above ground level, as described below.

The installation may include ventilation or air conditioning means for the interior of the chamber. In one version of the invention ventilation or air conditioning means are housed in a cubicle mounted on a roof of the chamber above ground level and communicating with the interior of the chamber. In other versions, the ventilation means may comprise a ventilation circuit which includes an air intake at an elevated position on the mast, an air exhaust at an elevated position on the mast, air intake ducting leading from the intake to the interior of the chamber and air exhaust ducting leading from the interior of the chamber to the air exhaust. In such versions it is preferred that the air exhaust be located towards the top of the mast and include an air extractor. It is also preferred that the mast be a hollow monopole mast with the air intake and air exhaust ducting is concealed in the interior of the mast.

Personnel access to the interior of the chamber is required for equipment maintenance or installation or other purposes. The invention envisages an arrangement in which there is an entrance cubicle on a roof the chamber above ground and a personnel access passage leading from the entrance cubicle to the interior of the chamber. The invention also envisages an alternative arrangement in which the mast is a hollow monopole mast which extends into the chamber and which has personnel access openings into the mast above ground and within the chamber, the personnel access openings and the interior of the mast providing a personnel access passage to the chamber.

The chamber will typically be of concrete, and possibly be at least partially of precast construction, although other materials and combinations or materials are within the scope of the invention.

The mast may carry one or more transverse, electric light-supporting arms each at an elevated position with electrical supply cables for the or each arm extending along the mast. This configuration would be particularly useful in situations where the chamber is located underground in an area alongside a road or between opposing lanes of a road.

BRIEF DESCRIPTION OF THE DRAWINGS

The invention will now be described, by way of example only, with reference to the accompanying diagrammatic drawings in which.

DESCRIPTION OF PREFERRED EMBODIMENTS

Figure 1:
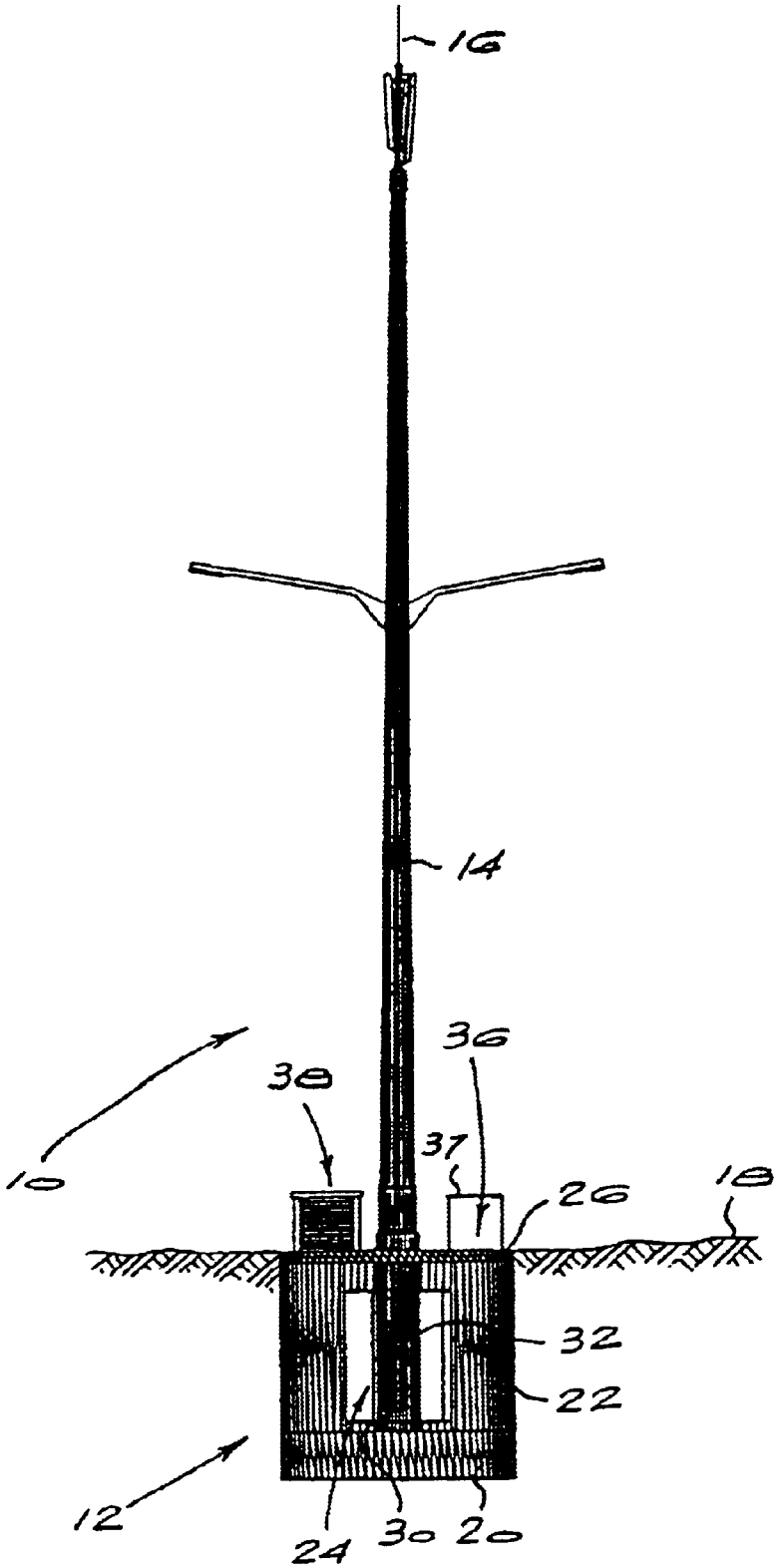
FIG. 1 shows, in partly cut away front view, an telecommunications mast installation in accordance a first embodiment of the invention.
Figure 2:
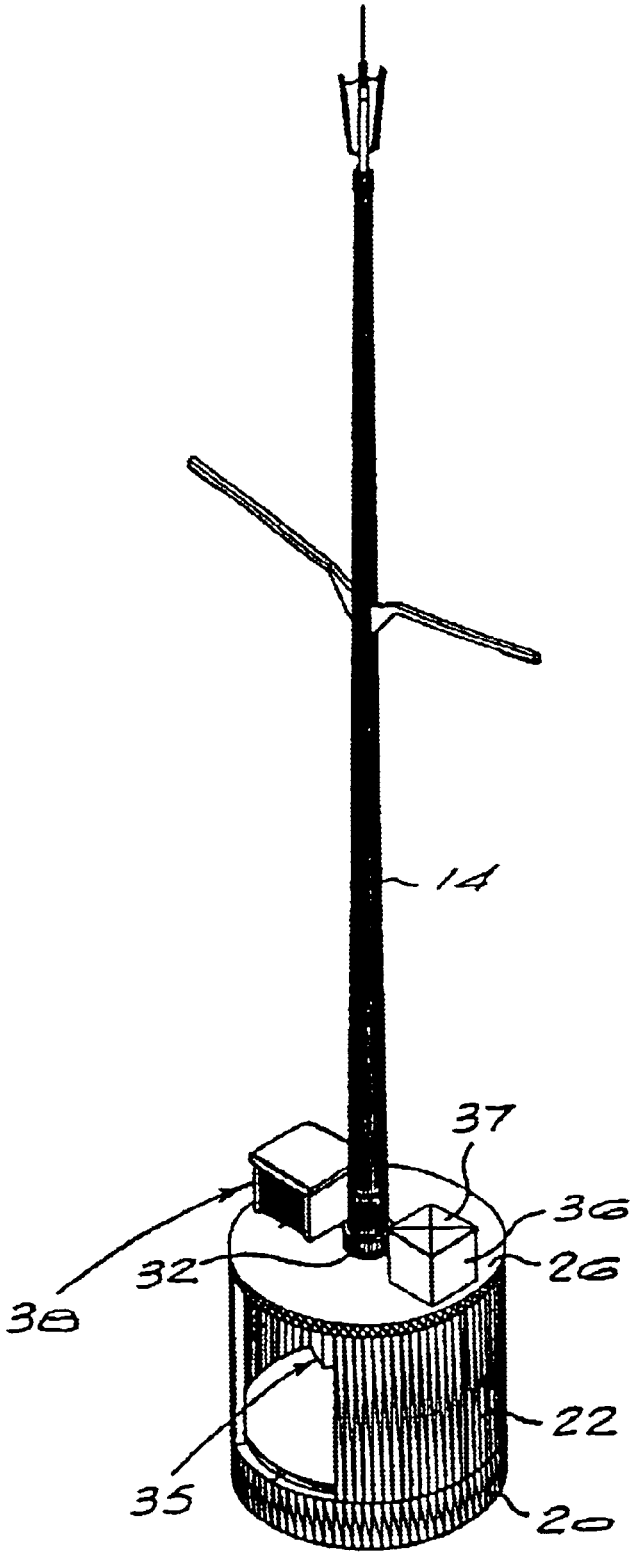
FIG. 2 shows the installation of FIG. 1 in a three dimensional, partly cut away view.

With reference to FIGS. 1 and 2 of the drawings, a telecommunications mast installation in accordance with a first embodiment of the invention is generally indicated by reference numeral 10. The installation 10 comprises a foundation structure 12 which is beneath ground level indicated by reference numeral 18 and a mast 14 mounted on and supported by the structure 12. The mast 14 extends vertically upwardly and an antenna 16 is mounted to the top of the mast.

The structure 12 forms a hollow chamber. It includes a base 20 of reinforced concrete which will typically have been cast in situ, although it may be a precast component.

The chamber also includes a round cylindrical shell 22 supported on the base 20 and securely connected to the base to form an integral structure. The shell 22 is conveniently in the form of a precast structure, or is formed of precast components. The chamber formed within the shell is designated with the reference numeral 24.

A roof 26 formed by a roof slab spans across and is supported by the shell 22. The roof 26 is securely connected to the shell and, together with the shell and base 20, forms a rigid, three dimensional, composite foundation for the mast 14.

A vertical sleeve 32 extends snugly through a hole in the roof 26 and is itself snugly located about a lower end of the mast 14. The lower end of the sleeve, coinciding with the lower extremity or foot of the mast 14, is snugly received in a recessed seat 30 provided for that purpose in the base 20. With this arrangement, vertical loading on the mast is transferred to the base 20 which serves as a structural foundation for the mast. In addition, the seat restrains lateral movements of the mast at the level of the base.

The roof 26, acting via an upper portion of the sleeve 32, laterally restrains the mast 14 at a position spaced from and directly above the seat 30. The structure 12 accordingly provides secure vertical and lateral support for the mast. It will however be understood that there is no rigid, moment-transferring connection between the mast and structure 12.

In other embodiments, not shown, the sleeve 32 may be omitted. In this case, the foot of the mast is received directly in the recessed seat 30, and is laterally restrained thereby at the level of the base, and the roof 26 applies direct lateral restraint to the mast above the base.

The interior of the chamber 24 accommodates electronic and other equipment 35 associated with the operation of the antenna 16 carried by the mast. A cubicle 36 exposed above ground level on the roof 26 provides an entrance to the chamber 24 to allow personnel access to the equipment accommodated within the chamber via a hatch 37 on the cubicle or via a door (not shown) in a side of the cubicle. In either event, it will be understood that the cubicle communicates with the chamber through an opening extending through the roof.

In an alternative arrangement where the mast 14 is a hollow monopole, typically of steel, there may be a door or hatch in the wall of the pole above the upper end of the sleeve 32 and a corresponding door or hatch through the lower end of the mast and sleeve inside the chamber 24, with the doors or hatches and the interior of the mast itself providing personnel access to the interior of the chamber. This arrangement does away with the need for an exposed, upstanding structure, i.e. the cubicle 36, on the roof.

The chamber 24 should be ventilated or air conditioned for the sake of the electronic equipment 35 and personnel working in the chamber 24. In FIGS. 1 and 2 necessary air conditioning or ventilation components are housed in a further, ventilated cubicle 38 located in an exposed position on the roof 26.

Figure 3:
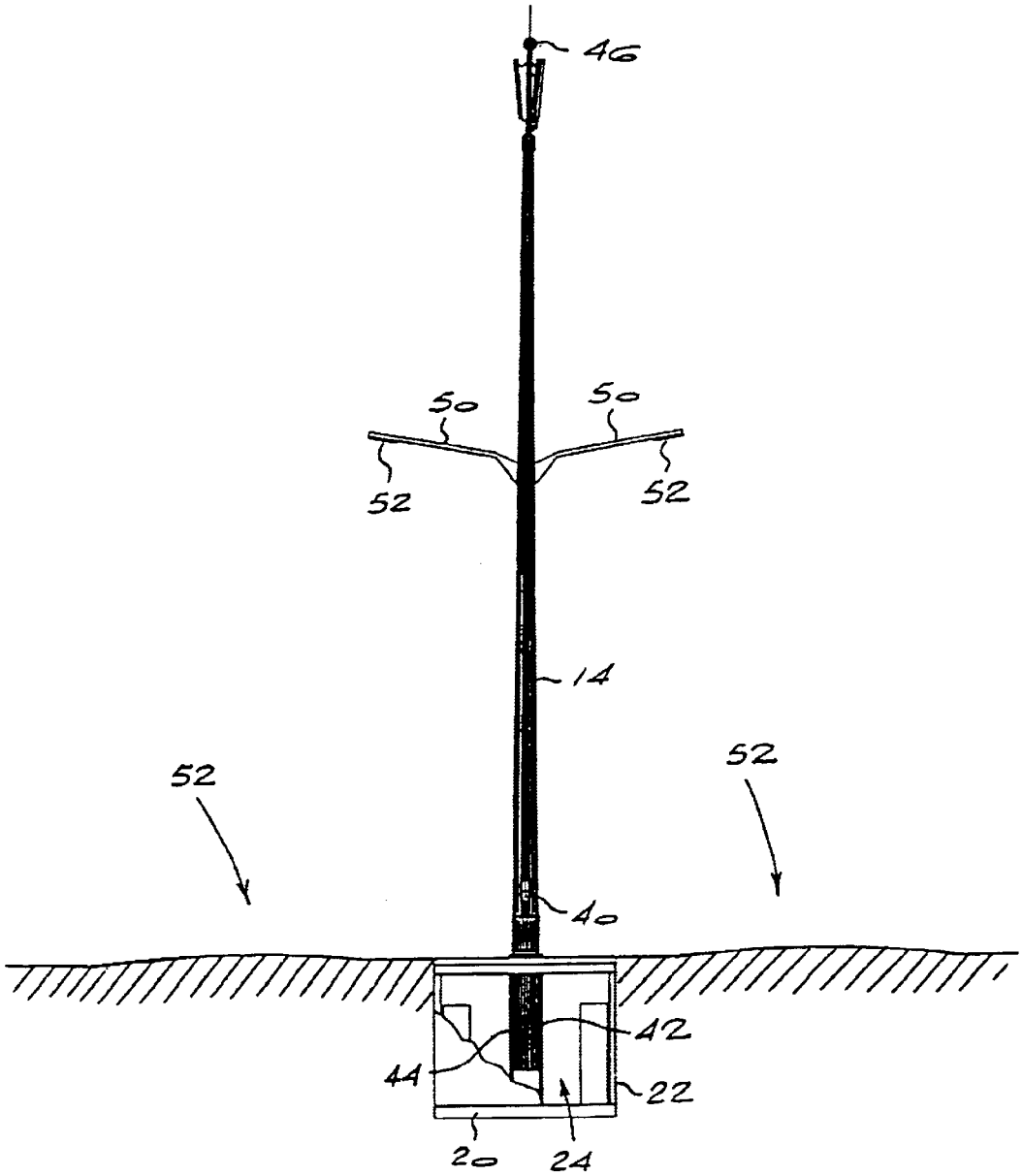
FIG. 3 shows a view similar to that of FIG. 1 of another embodiment of the invention.
Figure 4:
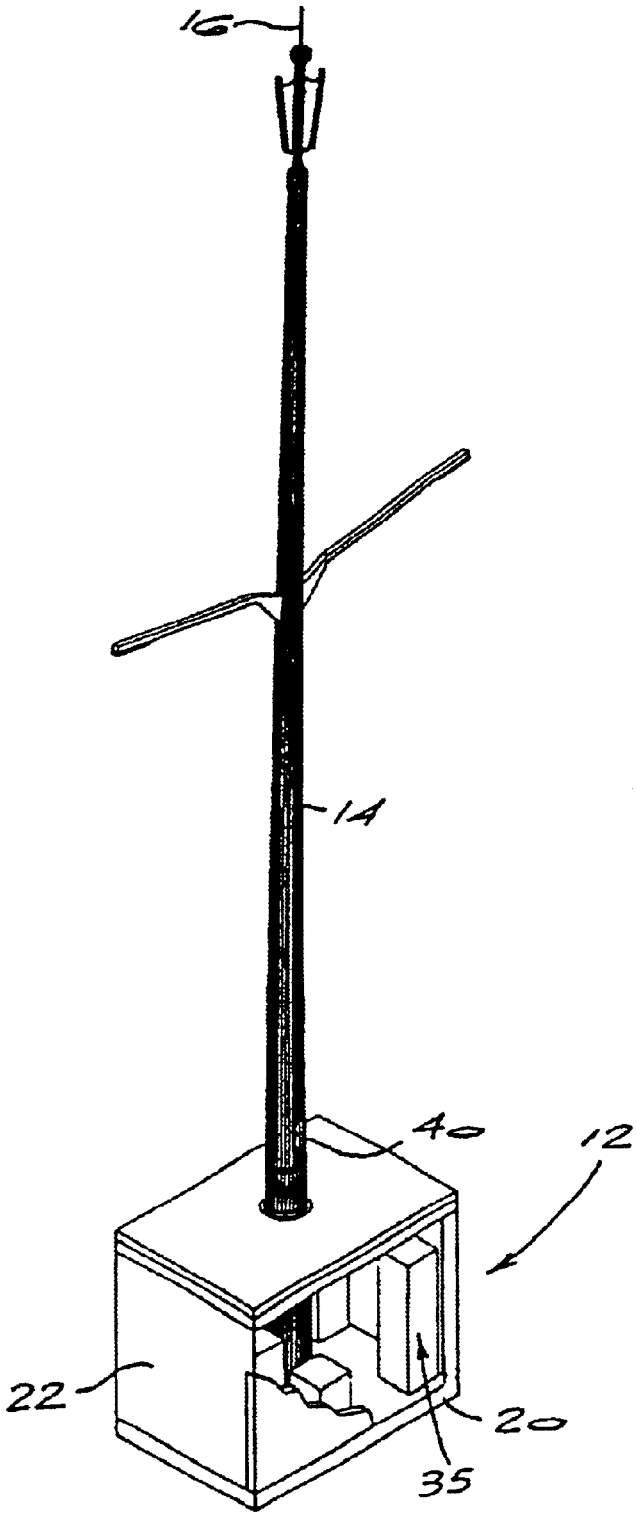
FIG. 4 shows a view similar to that of FIG. 2 of the embodiment of FIG. 3.

In the embodiment of FIGS. 3 and 4, the shell 22 is rectangular in shape rather than round cylindrical as in the first embodiment. Another difference between this embodiment and that of FIGS. 1 and 2 is the manner in which chamber ventilation is provided. An air intake 40 is provided in the wall of the monopole mast 14 at a level just above the sleeve 32. Inside the mast air intake ducting (not visible) is provided to take air to a vent 42 in the chamber. An inlet 44 in the chamber is connected via exhaust ducting in the mast 14 to an exhaust at the top of the mast. The exhaust includes is served by an air extractor 46, typically a rotary air-driven extractor of conventional type, such as that marketed under the trade name "Whirlybird". Alternatively, the extractor may be an electrically powered suction fan or the like. It will be appreciated that there is accordingly a ventilation circuit in which ventilating air is drawn into the chamber via the intake 40, concealed intake ducting and vent 42 and is withdrawn from the chamber to the exhaust via the inlet 44 and concealed exhaust ducting.

In the absence of a personnel access cubicle on the roof 26 in the embodiment of FIGS. 3 and 4, it will be understood that personnel access in this will typically be via the mast itself, as described above.

In both embodiments described above the mast 14 supports transverse, light-supporting arms 50 at an elevated position. The lights 52 which are supported may, for instance, be street lights. Electricity supply cabling for the lights will typically be taken to the light fittings in concealed manner through the interior of the mast. In practice, electrical power, either mains or independently generated, will have to be supplied to the chamber 24 and equipment 35 therein, as well as air conditioning equipment if provided, and it will accordingly be a simple matter to route power from the main supply to the light fittings 52 on the arms 50.

The facility, to support street lighting renders installations as described above eminently suitable for location alongside roads. This is exemplified in FIG. 3, in which the opposing lanes of a highway are designated with the numeral 52 and the installation of the invention is located in the island or strip between those lanes. There may of course be only a single arm supporting a single light fitting.

It will also be understood that the antenna 16 is connected in conventional fashion to the associated equipment in the chamber by conductors extending internally along the mast 14.

The installations described above have a number of advantages compared to conventional cellular telephone network base station installations as mentioned above. One important advantage is the fact that the installations are not visually intrusive because, even with an embodiment of the kind seen in FIGS. 1 and 2, the structure 12 is predominantly below ground and hence is largely invisible. The fact that the chamber is below ground also makes it possible to provide a telecommunications mast right next to a road or, as described above, in the inter-lane strip of a highway. In this regard it will be understood that it will be possible to position installations according to the invention in other locations where conventional installations would be unacceptable, for instance in building or sports complexes.

From a security point of view vulnerable electronic and other equipment associated with the operation of the antenna supported by the mast is securely positioned underground within the installation 12, obviating the need for above-ground security fencing or the like.

Yet further, the three dimensional composite foundation structure 12 securely and conveniently supports the mast 14.

Yet another advantage arises from the subterranean location of the chamber 24. Thermal inertia and the shielding effect of the soil surrounding the chamber will, it is believed, facilitate the maintenance of a suitably cool enivronment by ventilation or air conditioning of the chamber.

In another, less preferred embodiment of the invention, not illustrated, the foot of the mast 14 is secured rigidly to the roof slab of the chamber. Although quite feasible, and may in fact be desirable in the case of, for instance, mast of lattice construction, this is considered less desirable than the embodiments described above because it would necessitate a foundation structure, and in particular roof slab structure, robust enough to take force moments transmitted to it by the mast. This is avoided in arrangements such as those illustrated in the drawings, where the mast is supported by, but not rigidly connected to the foundation structure, with the foundation structure providing lateral restraint at the level of the base and roof and the soil surrounding the foundation structure providing the necessary passive resistance.

What is claimed is:

1. A telecommunications mast installation comprising:

a mast;

a telecommunications antenna supported by the mast; and a foundation structure supporting the mast;

the foundation structure including an enclosed chamber situated at least partially underground, the chamber having a roof and a base, and defining an internal space which is accessible to personnel and which accommodates electronic equipment associated with operation of the antenna, the mast passing through an opening in the roof with a foot at the lower end of the mast supported by the base, wherein the base acts as a structural foundation for the mast and the roof serves as a lateral support means to restrain lateral movements of the mast at a position above the base without transfer of bending moments between the mast and the foundation structure.

2. An installation according to claim 1 wherein the chamber is fully underground.

3. An installation according to claim 1, further comprising a seat in or on the base, wherein the foot of the mast is seated on the seat, the seat restraining lateral movements of the foot of the mast at the base.

4. An installation according to claim 3 further comprising a sleeve about the lower end of the mast, the sleeve being received by the seat and passing through the opening in the roof.

5. An installation according to claim 1 further comprising ventilation or air conditioning means for the internal space of the chamber.

6. An installation according to claim 5 further comprising a cubicle mounted on the roof of the chamber above ground level and communicating with the internal space of the chamber, wherein the ventilation or air conditioning means is provided in the cubicle.

7. A telecommunications mast installation comprising:

a mast;

a telecommunications antenna supported by the mast;

a foundation structure supporting the mast, the foundation structure including an enclosed chamber defining an internal space, and electronic equipment within the internal space for operating the antenna, and the foundation structure providing access to the internal space when the chamber is at least partially underground; and a ventilation or air conditioning means for the internal space of the chamber, wherein the ventilation means comprises a ventilation circuit which includes an air intake on the mast, an air exhaust at an elevated position on the mast, air intake ducting leading from the intake to the internal space of the chamber and air exhaust ducting leading from the internal space of the chamber to the air exhaust.

8. An installation according to claim 7 wherein the air exhaust is located towards a top of the mast and includes an air extractor.

9. An installation according to claim 7 wherein the mast comprises a hollow monopole mast having an interior, the air intake is an opening in a wall of the mast and the air intake and air exhaust ducting is concealed in the interior of the mast.

10. An installation according to claim 1 further comprising a personnel entrance cubicle on the roof of the chamber and a personnel access passage leading from the entrance cubicle to the internal space of the chamber.

11. A telecommunications mast installation comprising:

a mast;

a telecommunications antenna supported by the mast; and a foundation structure supporting the mast, the foundation structure including an enclosed chamber defining an internal space, and electronic equipment within the internal space for operating the antenna, and the foundation structure providing access to the internal space when the chamber is at least partially underground, wherein the mast comprises a hollow monopole mast having an interior which extends into the chamber, and personnel access openings into the mast within the chamber, the personnel access openings and the interior of the mast providing a personnel access passage to the chamber.

12. An installation according to claim 1 wherein the chamber is constructed of concrete.

13. An installation according to claim 12 wherein the chamber is constructed at least partially of precast concrete.

14. An installation according to claim 1 further comprising one or more transverse, electric light-supporting arms, each carried by the mast at an elevated position and electrical supply cables for each arm extending along the mast.

15. A telecommunications mast installation, comprising:

a foundation structure;

a mast mounted on and supported by the foundation structure;

at least one antenna mounted to the mast;

the foundation structure including a hollow chamber defined by a base, a shell supported on and connected to the base, and a roof supported by and connected to the shell; and a personnel access entrance to the chamber, the mast passing through an opening in the roof and a foot of the mast supported by the base, the base providing a structural foundation for the mast and the roof restraining lateral movement of the mast at a position above the base without transfer of a bending moment between the mast and the foundation structure.

16. A telecommunications mast installation, comprising:

a foundation structure;

a mast mounted on and supported by the foundation structure;

the foundation structure including a hollow chamber defined by a base, one or more walls mounted to the base and a roof mounted to the one or more walls;

a personnel access entrance to the chamber;

air intake ducting in the mast communicating between an inlet in the mast and an interior of the chamber; and air exhaust ducting communicating between the interior of the chamber and an outlet in the mast.

* * * * *